United States Patent [19]

Darmanin

[11] Patent Number: 4,749,090

[45] Date of Patent: Jun. 7, 1988

[54] FOLDABLE DISPLAY RACK

[76] Inventor: Manuel Darmanin, 26 Country Club Rd., Bellport, N.Y. 11713

[21] Appl. No.: 53,488

[22] Filed: May 26, 1987

[51] Int. Cl.[4] ..... A47F 7/00

[52] U.S. Cl. ..... 211/50; 211/113; 211/118; 40/124

[58] Field of Search ..... 211/50, 195, 118, 182, 211/113, 55; 248/205.3; 40/124

[56] References Cited

U.S. PATENT DOCUMENTS

| | | | |
|---|---|---|---|
| 896,295 | 8/1908 | Haines | 211/113 X |
| 1,741,068 | 12/1929 | Newsom | 211/113 X |
| 1,858,653 | 5/1932 | Willcox | 211/113 |
| 4,122,857 | 10/1978 | Haerr | 248/205.3 X |
| 4,387,873 | 6/1983 | Pavlo et al. | 211/113 X |
| 4,424,908 | 1/1984 | Davitz | 211/118 |
| 4,523,526 | 6/1985 | O'Neill | 211/118 X |

FOREIGN PATENT DOCUMENTS

| | | | |
|---|---|---|---|
| 10144 | of 1913 | United Kingdom | 211/113 |
| 1045379 | 10/1966 | United Kingdom | 211/113 |
| 2044092 | 10/1980 | United Kingdom | 211/118 |

*Primary Examiner*—Ramon S. Britts
*Assistant Examiner*—Sarah A. Lechok Eley
*Attorney, Agent, or Firm*—Alfred M. Walker

[57] ABSTRACT

A foldable display rack comprises two side chain members each provided with a plurality of chain members each having a link hole, the chain members being spaced from one another in a first direction, and a plurality of transverse rod-like members each passing through one hole of one link of one of the chain members and one hole of one link of the other of the chain members and spaced from one another in a second direction which is transverse to the first direction, the links of the chain members are formed so that they are connected with one another movably so as to allow folding of the chain members and therefore folding of the display rack, and at the same time the chain links allow passing the rod-like members therethrough and therefore support the rod-like members.

7 Claims, 2 Drawing Sheets

Fig. 4
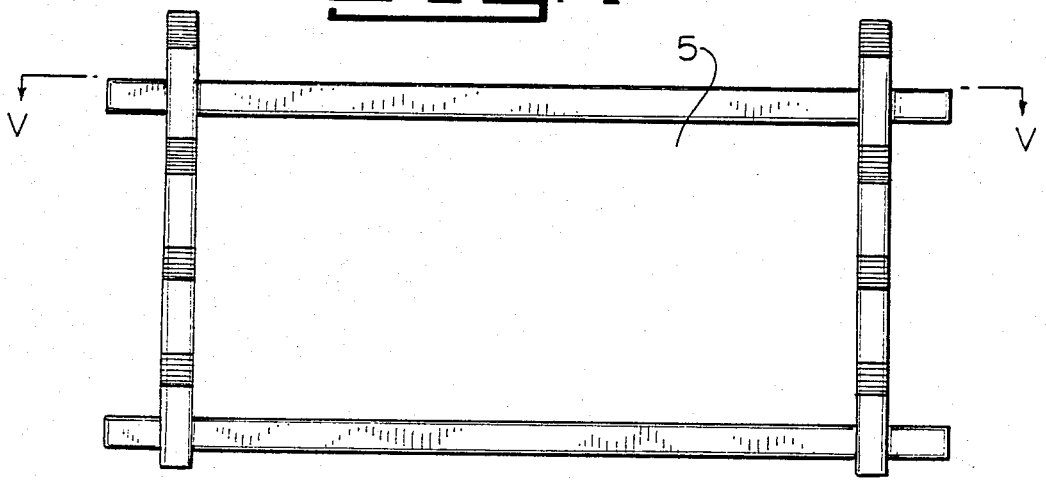
Fig. 5
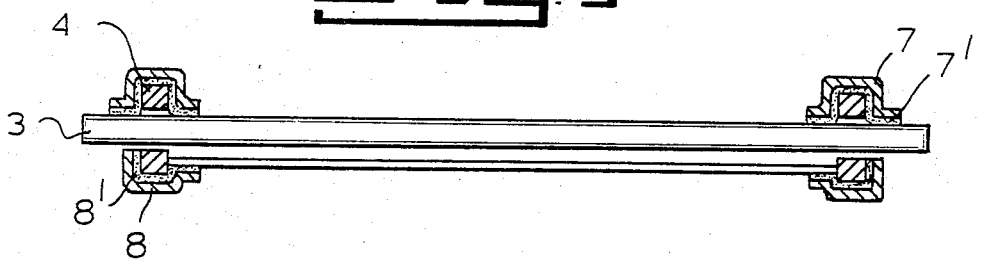
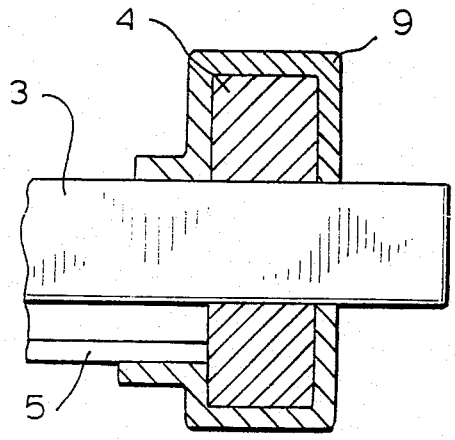
Fig. 6

FOLDABLE DISPLAY RACK

BACKGROUND OF THE INVENTION

The present invention relates to a foldable display rack, and more particularly to a foldable display rack which can be used for displaying cards.

Display racks of the above mentioned general type are known in the art. Some of such display racks are disclosed in the U.S. Pat. Nos. 419,235; 969,495; 762,978; 1,858,653; 2,513,806; 3,952,875; 4,052,805. The display racks disclosed in these references are foldable for convenience and include side members spaced from one another in a first direction and a plurality of transverse members supported by the side members and spaced in a second direction which is transverse to the first direction. A very advantageous display rack is disclosed in the U.S. Pat. No. 1,858,653, in which the side members are formed as chains, and transverse members are formed as rods supported by the chains. In this display rack, however, the chains are provided with additional rings through which the transverse rods are passed. Thus, the side members must have two different components, namely the links of the chains which are connected with one another in a movable fashion so as to allow folding of the display rack, and additional rings which are used directly for supporting the transverse rods. Such construction is relatively complicated to manufacture.

SUMMARY OF THE INVENTION

Accordingly, it is an object of the present invention to provide a display rack which avoids the disadvantages of the prior art.

More particularly, it is an object of the present invention to provide a foldable display rack which has a simple construction and is easy to manufacture than the known foldable display racks. In keeping with these objects and with others which will become apparent hereinafter, one feature of the present invention resides, briefly stated, in a foldable display rack which has side chain members each composed of a plurality of chain links, each having a hole, and the side chain members are spaced from one another in a first direction, and a plurality of transverse rod-like members each passing through the hole of one link of one of the side chain members and through the hole of one link of the other of the chain members and spaced from one another in a second direction which is transverse to the first direction, wherein the links of the side chain members are formed so that they are movably connected with one another so as to allow rolling up of the side chain members and therefore folding of the display rack and at the same time the same chain links allow passing of the transverse rod-like members therethrough and supporting the same.

When the foldable display rack is designed in accordance with the present invention, it has a simple construction and is easy to manufacture, since the same links of the chains perform a double function of being movably connected with one another to allow the rolling up of the chains, and at the same time allowing the passage of the transverse rod-like members therethrough to provide their support.

In accordance with another feature of the present invention, the holes in the links of the chain members and the cross section of the transverse rod-like members are selected so that the rod-like members cannot turn in the holes and are retained in them. More particularly, the holes in the links of the chains and the cross section of the rod-like members can be rectangular, so that the rod-like members cannot turn in the holes and at the same time the upper surface of the rod-like members provides a support for cards and other objects to displayed.

In accordance with still a further feature of the present invention, each chain member can be provided with a ribbon which can be attached to it, for example by an adhesive layer. The ribbon not only performs a decorative function, but also can connect the respective chain member to the respective end of the transverse rod-like members so as to secure them to one another. Finally, the same ribbon can also attach a back wall which can be provided in the display rack, to the chain members and the rod-like members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 2 is a perspective view of a part of one chain member with two transverse rod-like members extending through;

FIG. 4 is a rear view of a portion of the foldable display rack of the present invention;

FIG. 5 is a section taken along the line V—V in FIG. 4 and showing one modification of the foldable display rack of the present invention; and FIG. 6 is a view substantially corresponding to the fragment of FIG. 5, but showing another modification of the present invention.

DESCRIPTION OF PREFERRED EMBODIMENTS

Figure 1:
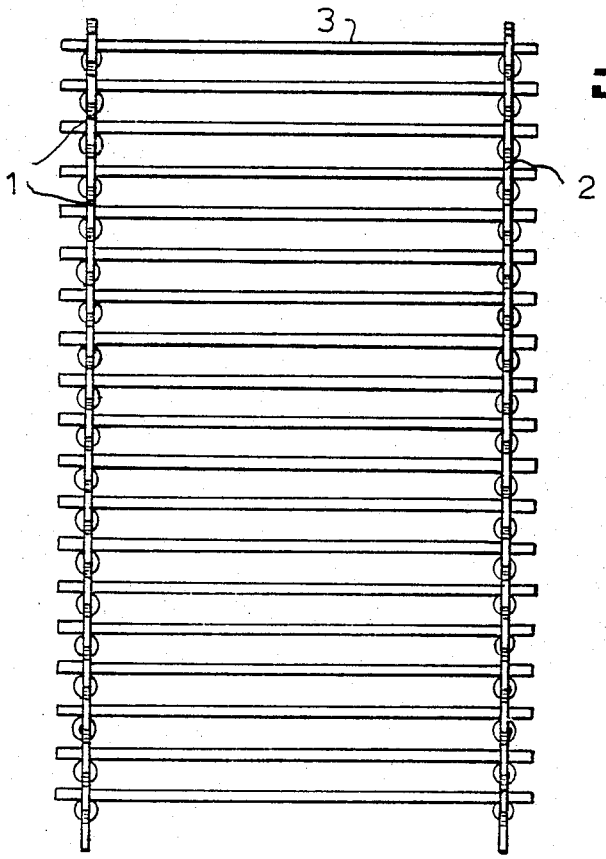
FIG. 1 is a schematic front view of a foldable display rack in accordance with the present invention.

A foldable display rack in accordance with the present invention has two side chain members identified with references 1 and 2. A plurality of transverse rod-like members extend between the chain members 1 and 2. Each rod-like member passes with its two ends through a hole of one link of one chain member 1 and the hole of one link of the other chain member 2. It is understood that the rod-like members 3 are not inserted in every link of the chain members. Depending on the size of the objects to be displayed, they can be inserted to each second or third or fourth, etc., link of the chain members 1 and 2.

Figure 2:
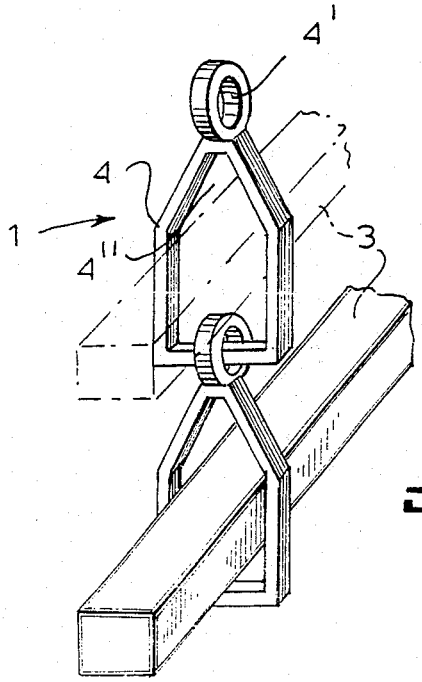

As can be seen from FIG. 2, the chain links 4 of the chain members, for example the chain member 1 shown in this Figure, are connected movably with one another. This can be achieved in various ways, for example a hole in an upper projection of each lower link is somewhat bigger than the cross section of the lower leg of the upper link so that the lower leg of the upper link can slide and turn in the hole of the upper projection of the lower link in each chain member. The hole of the upper projection of the link is identified with reference numeral 4'.

Each chain link 4 has a central main hole 4" through which the rod-like members 2 can pass. In accordance with the invention, the shape of the main hole 4' in the links and the cross section of the rod-like members are selected so that the rod-like members 2 cannot turn in the holes 4" of the links 4 of the chain members 1 and 2. As can be from FIG. 2, the shape of the main hole 4" and the cross section of the rod-like members 2 are rectangular, for example square. Moreover, the size of the holes 4" of the links 4 and of the cross sections of the rod-like members 2 substantially corresponds to one another, so as to prevent the above specified relative turning.

The rectangular cross section of the rod-like members is also convenient for supporting an object to be displayed in the display rack, since the upper flat surface of the rectangular rod-like member serves as a reliable supporting surface for the objects. The same is true with respect to the convenience of supporting a back wall which can be provided in the foldable display rack. A back wall, or more particularly a plurality of back wall portions 5 can be arranged so that each back wall portion 5 is inserted between two neighboring rod-like members 3 and stands on the flat upper surface of the lower rod-like member as shown in dash line in FIG. 2. An object to be displayed which is identified with reference numeral 6 can be arranged between the two neighboring rod-like members 3 with rear abutment against the back wall portion 5. It is to be understood that the objects to be displayed, for example cards, can be held in the display rack in a different manner, for example by suspending on the rod-like members with a rearwardly bent portion of the card, with an additional hook, etc.

Figure 3:
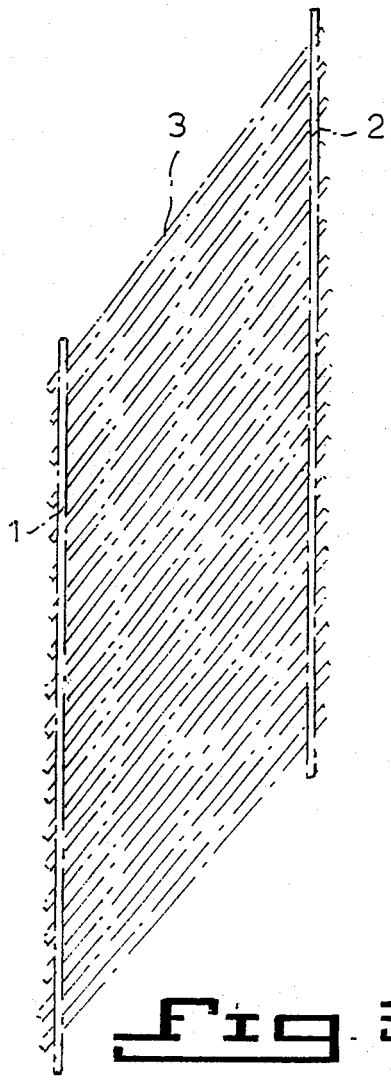
FIG. 3 is a view schematically showing folding of the inventive foldable display rack.

Since the links 4 of the chain members 1 and 2 are connected with one another in a movable manner, the display rack in accordance with the invention can be folded in different ways. The rod-like members 2 can be inclined relative to the chain members 1 and 2 so that the display rack is folded as shown in FIG. 3. It is to be understood that for this purpose the height of the hole 4' in each link 4 of the chain members 1 and 2 is somewhat greater than the height of the cross section of the rod-like members 3, so as to allow the above mentioned inclination of the rod-like members relative to the chain members. On the other hand, the display rack can be folded simply by its rolling up so as to form a roll. It is also to be understand that to form a very tight roll, the back portions 5 have to be removed from the spaces between the neighboring rod-like members. The same is necessary for folding the display in the fashion shown in FIG. 3.

In accordance with a further advantageous feature of the present invention, additional ribbons 7 are provided, each associated with a respective one of the chain members 1 and 2. The ribbons 7 can have an adhesive rear surface. First of all, the ribbons perform purely decorative functions and can be of bright colors, for example red or blue. In addition, the ribbons can perform important functions of securing the respective parts of the display rack. As shown in FIG. 5, each ribbon 7 surrounds a front leg of the links 4 and extends over a part of the rod-like member 3 so as to be secured by its adhesive layer 7' both to the front leg of the link 4 and the front surface of the rod-like member 3. In this manner the rod-like members 3 are secured to the links 4 of the chain members 1 and 2.

FIG. 5 shows also additional ribbons 8 which are provided at the rear side of the chain members 1 and 2. Each ribbon 8 is secured with its adhesive layer 8' to the rear leg of the links 4 of the chain members 1 and 2 and to a part of the respective back wall portion 5, so that the back wall portion 5 becomes firmly connected with the respective links 4. Thus, the ribbons 7 provide for a firm connection between the rod-like members 3 and the links 4 of the chain members 1 and 2, while the ribbons 8 provide for a firm connection of the back wall portions 5 to the links 4 of the chain members 1 and 2.

FIG. 6 shows a further modification of the present invention. Here, a single ribbon 9 extends over a part of the rod-like member 3, a front leg of the link 4, a rear leg of the link 4 and a part of the back wall portion 5. Therefore, the same ribbon 9 provides for a firm connection of the rod-like members 3 and the back wall portions 5 to the links 4 of the chain members 1 and 2.

It will be understood that each of the elements described above, or two or more together, amy also find a useful application in other types of constructions differing from the types described above.

While the invention has been illustrated and described as embodied in a foldable display rack, it is not intended to be limited to the details shown, since various modificationse and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A foldable display rack, comprising two side chain members each provided with a plurality of links each having a link hole, said chain members being spaced from one another in a first direction; and a plurality of transverse rod-like members each passing through one said link hole of one of said chain members and one said link hole of the other of said chain members and spaced from one another in a second direction which is transverse to said first direction, said links of said chain members being formed so that they are connected with one another movable so as to allow folding of said chain members and thereby folding of the display rack by rolling up said chain members, and at the same time said links allow passing said rod-like members therethrough and therefore supporting the rod-like members, and said rod-like members and said holes in said links being dimensioned relative to one another so that said rod-like members can be inclined relative to said chain members so as to allow folding of said chain members by displacing said chain members relative to one another in a direction of their elongation and further comprising a plurality of back wall portions each located between two neighboring ones of said rod-like members and connected to said links so as to support objects to be displayed from their rear side.

2. A foldable display rack as defined in claim 1, wherein said holes of said link of said chain members have a non-round shape, said rod-like members having a non-round cross section substantially corresponding to the shape of said holes of said links of chain members, so that said rod-like members cannot turn in said holes of said links of said chain members.

3. A foldable display rack as defined in claim 2, wherein the shape of said holes of said links of said chain members and the cross section of said rod-like members are rectangular.

4. A foldable display rack as defined in claim 1; and further comprising least at one ribbon extending over at least one of said chain members and connecting said links of said at least one chain member to said rod-like members.

5. A foldable display rack as defined in claim 1; and further comprising at least one ribbon extending over at least one of said chain members and connecting said links of said at least one chain member to said back wall portions.

6. A foldable display rack as defined in claim 1; and further comprising at least one ribbon extending over at least one of said chain members and connecting said at least one chain member both with said rod-like members and with said back wall portions.

7. A foldable display rack as defined in claim 4, wherein said ribbon is provided with a front main layer and a rear adhesive layer.

* * * * *